US010801159B2

(12) United States Patent
Pan et al.

(10) Patent No.: US 10,801,159 B2
(45) Date of Patent: Oct. 13, 2020

(54) WATER TUBE AND A STEAMER HAVING THE SAME

(71) Applicant: Tsann Kuen (Zhangzhou) Enterprise Co., Ltd., Zhangzhou, Fujian (CN)

(72) Inventors: Chih-Jung Pan, Fujian (CN); Ruifeng Cai, Fujian (CN); Zhenxing Zheng, Fujian (CN)

(73) Assignee: TSANN KUEN (ZHANGZHOU) ENTERPRISE CO., LTD., Zhangzhou, Fujian (CN)

( * ) Notice: Subject to any disclaimer, the term of this patent is extended or adjusted under 35 U.S.C. 154(b) by 190 days.

(21) Appl. No.: 16/006,206

(22) Filed: Jun. 12, 2018

(65) Prior Publication Data

US 2018/0363236 A1 Dec. 20, 2018

(30) Foreign Application Priority Data

Jun. 14, 2017 (CN) ..... 2017 1 0447784
May 30, 2018 (CN) ..... 2018 1 0536807

(51) Int. Cl.
*D06F 75/30* (2006.01)
*D06F 75/10* (2006.01)
(Continued)

(52) U.S. Cl.
CPC ..... *D06F 75/30* (2013.01); *D06F 75/10* (2013.01); *D06F 87/00* (2013.01); *D06F 75/14* (2013.01);
(Continued)

(58) Field of Classification Search
CPC ..... D06F 75/00–38; D06F 87/00; F22B 1/28; F22B 1/284; F22B 1/287; F22B 1/282;
(Continued)

(56) References Cited

U.S. PATENT DOCUMENTS 1,580,293 A * 4/1926 Fitzer ..... F22B 1/287 392/399
2,178,512 A * 10/1939 Schreyer ..... D06F 75/16 38/77.82
(Continued)

FOREIGN PATENT DOCUMENTS

CN 2277318 Y 4/1998
CN 105063983 A 11/2015

OTHER PUBLICATIONS

The Search Report issued to European counterpart application No. 18177393.8 by the EPO dated Oct. 17, 2018.
(Continued)

*Primary Examiner* — Ismael Izaguirre

(57) ABSTRACT

A water tube is adapted for use in a steamer. The steamer has a steam chamber and a heating plate that is disposed under the steam chamber. The water tube includes a tubular main body, a dividing body, and a plurality of ribs. The main body defines a channel extending in a flowing direction. The channel has an inlet portion, and an outlet portion that is opposite to and disposed downstream of the inlet portion, and that is adapted to extend into the steam chamber. The dividing body is inserted into the outlet portion of the channel. The ribs extend from the dividing body to the main body, and cooperate with the dividing body to divide the outlet portion of the channel into a plurality of outlet holes.

17 Claims, 15 Drawing Sheets

(51) Int. Cl.
*D06F 87/00* (2006.01)
*D06F 75/14* (2006.01)
*D06F 75/18* (2006.01)
*F22B 1/28* (2006.01)

(52) U.S. Cl.
CPC ..... *D06F 75/18* (2013.01); *F22B 1/284* (2013.01); *F22B 1/287* (2013.01)

(58) Field of Classification Search
CPC ... F22B 1/285; F24F 6/00; F24F 6/008; F24F 6/08; F24F 6/10; F16K 21/00; F16K 21/02; F16K 31/12
See application file for complete search history.

(56) References Cited

U.S. PATENT DOCUMENTS 2,338,739 A * 1/1944 Schreyer ..... D06F 75/16 38/77.82
2,550,825 A * 5/1951 Kolodie ..... D06F 75/14 38/77.8
2,617,212 A * 11/1952 Ellinwood ..... D06F 75/16 38/77.8
2,618,875 A * 11/1952 Vieceli ..... D06F 75/18 38/77.81
3,006,378 A * 10/1961 Erickson ..... G05D 7/012 138/46
4,070,773 A * 1/1978 Gowdy ..... D06F 75/18 38/77.83
4,149,328 A 4/1979 Hammer et al.
4,833,298 A * 5/1989 Wilkins ..... B44C 7/027 392/399
5,345,703 A * 9/1994 Farrington ..... D06F 75/18 38/77.5

OTHER PUBLICATIONS

Search Report appended to an Office Action, which was issued to Chinese counterpart application No. 201810536807.5 by the CNIPA dated Jun. 3, 2020 with an English translation thereof.

* cited by examiner

WATER TUBE AND A STEAMER HAVING THE SAME

CROSS-REFERENCE TO RELATED APPLICATION

This application claims priorities of Chinese Patent Application No. 201710447784.6, filed on Jun. 14, 2017, and Chinese Patent Application No. 201810536807.5, filed on May 30, 2018.

FIELD

The disclosure relates to a steamer, more particularly to a water tube of a steamer.

BACKGROUND

As shown in FIGS. 1 and 2, a conventional steamer 1, such as an iron, includes a heating plate 11 and a water tube 12 for pouring liquid water onto the heating plate 11. The water tube 12 defines a tube channel 121 that has an inlet portion 122 and an outlet portion 123. The outlet portion 123 has one and only one round outlet 124.

After the liquid water is sufficiently heated by the heating plate 11 to evaporate into steam, the steam exits the steamer to remove creases on clothes. However, the conventional steamer 1 tends to have a low efficiency where a relatively small amount of steam is generated per unit time, and where the water poured onto the heating plate 11 may not be rapidly and effectively converted into steam. In use, a portion of the liquid water which is not fully evaporated may prematurely exit the conventional steamer 1 alongside the steam, excessively wetting the clothes during its exiting process. Consequentially, the clothes may have to be air-dried or machine-dried after the ironing process.

SUMMARY

Therefore, an object of the disclosure is to provide a water tube for a steamer that can alleviate at least one of the drawbacks associated with the abovementioned prior art.

Accordingly, a water tube is adapted for use in a steamer. The steamer has a steam chamber and a heating plate that is disposed under the steam chamber. The water tube includes a tubular main body, a dividing body, and a plurality of ribs. The main body defines a channel extending in a flowing direction. The channel has an inlet portion, and an outlet portion that is opposite to and disposed downstream of the inlet portion, and that is adapted to extend into the steam chamber. The dividing body is inserted into the outlet portion of the channel. The ribs extend from the dividing body to the main body, and cooperate with the dividing body to divide the outlet portion of the channel into a plurality of outlet holes, such that water which enters the channel from the inlet portion is divided by the dividing body and the ribs into a plurality of streams that are adapted to be discharged respectively via the outlet holes into the steam chamber to fall onto the heating plate.

Another object of the disclosure is to provide a steamer that includes the abovementioned water tube.

Accordingly, a steamer includes a casing, a heating plate, and the abovementioned water tube. The heating plate is coupled to the casing, and cooperates with the casing to define a steam chamber therebetween. The water tube is mounted in the casing and extends into the steam chamber.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
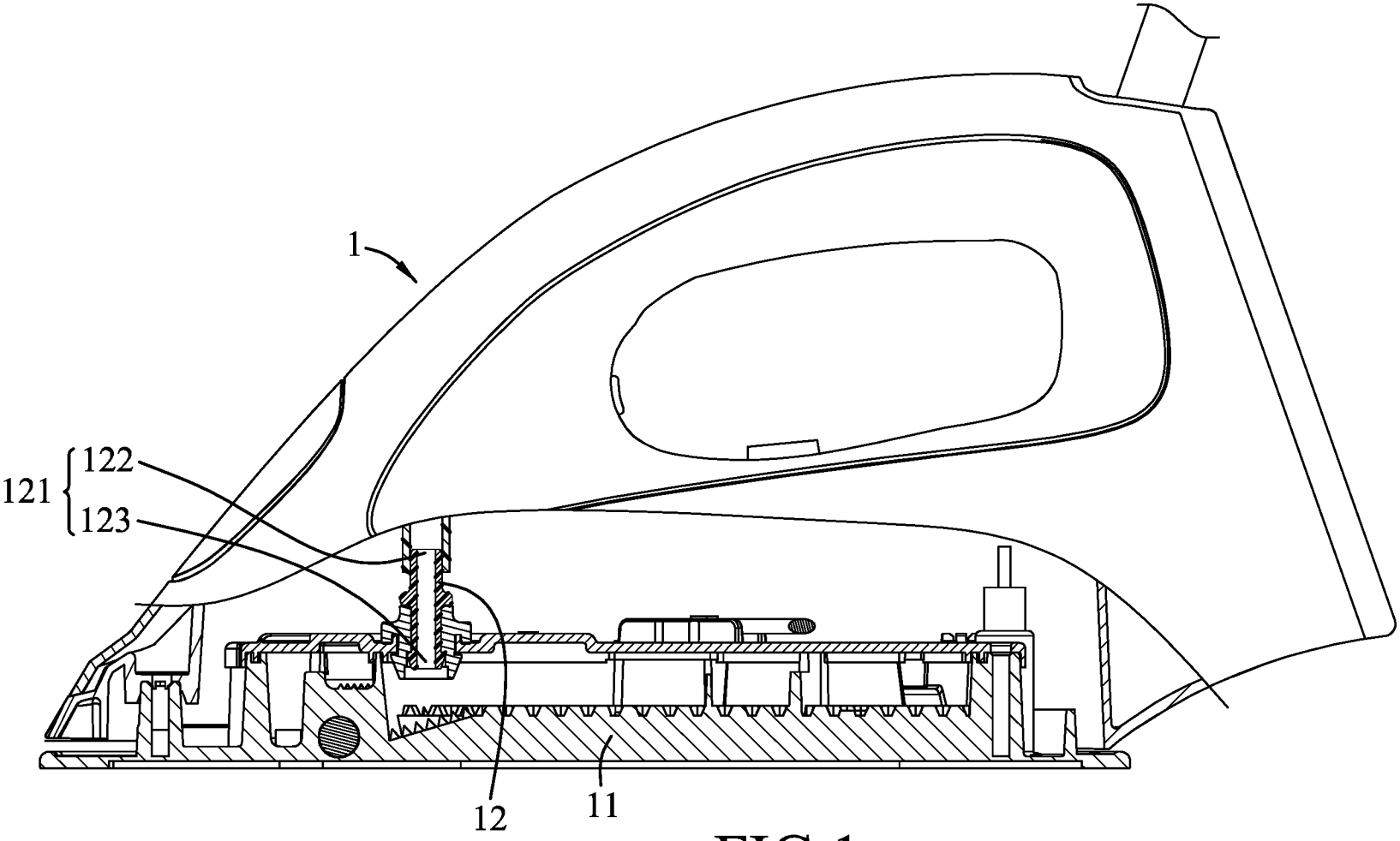
FIG.1 PRIOR ART
FIG. 1 is a fragmentary sectional view of an iron mounted with a conventional water tube.
Figure 2:
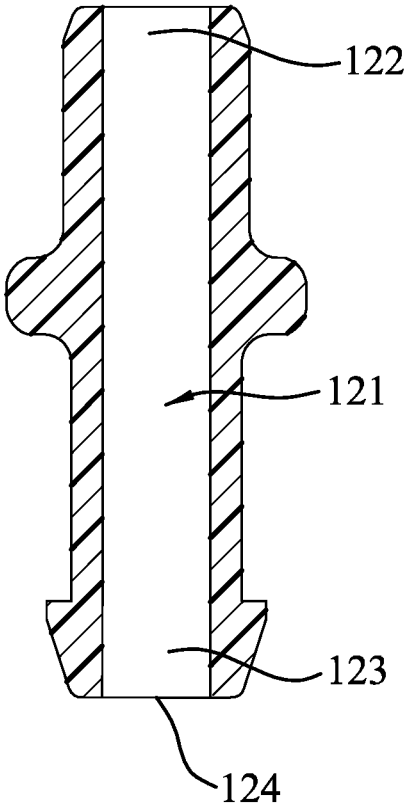
FIG.2 PRIOR ART
FIG. 2 is a sectional view of the conventional water tube.
Figure 3:
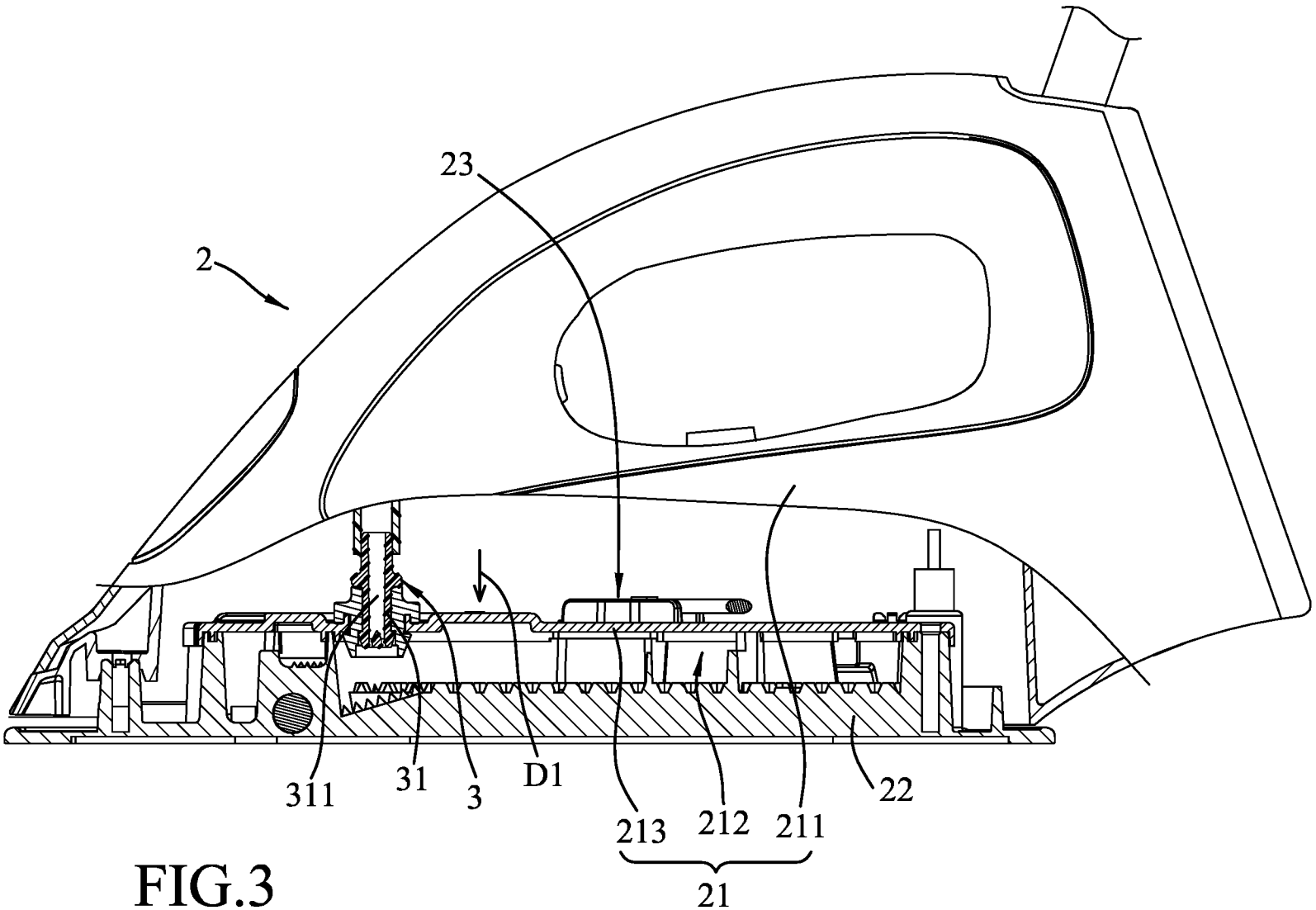
FIG. 3 is a fragmentary sectional view of an iron mounted with a first embodiment of a water tube according to the disclosure.
Figure 4:
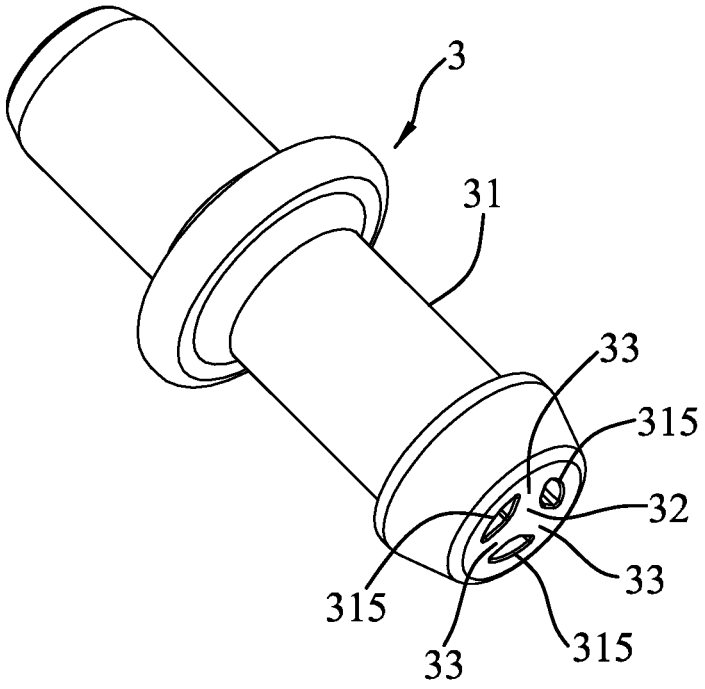
FIG. 4 is a perspective view of the first embodiment.
Figure 5:
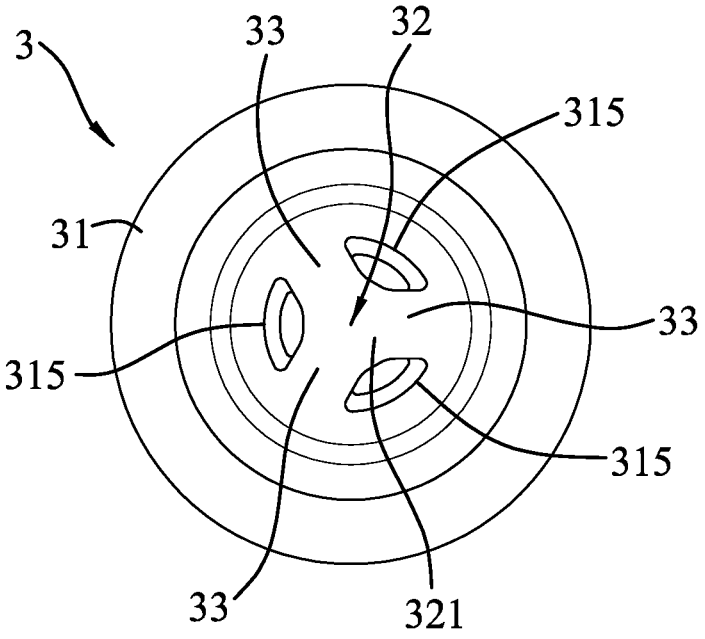
FIG. 5 is a bottom view of the first embodiment.
Figure 6:
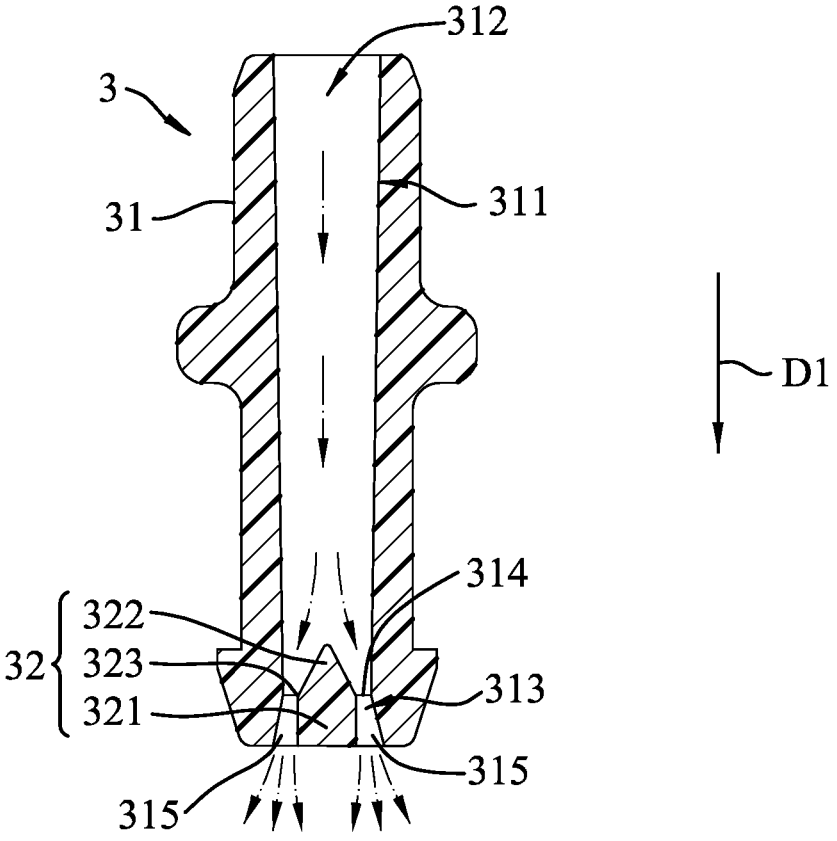
FIG. 6 is a sectional view of the first embodiment.

Before the present invention is described in greater detail, it should be noted that where considered appropriate, reference numerals or terminal portions of reference numerals have been repeated among the figures to indicate corresponding or analogous elements, which may optionally have similar characteristics.

As shown in FIGS. 3 to 6, the first embodiment of a water tube 3 according to the present disclosure is adapted to be mounted in a steamer 2. In this embodiment, the steamer 2 is configured as a steam iron. The steamer 2 includes a casing 21, a heating plate 22 that is coupled to a bottom end of the casing 21, a control unit 23 that is disposed in the casing 21, and a water tube 3 that is mounted in the casing 21.

The casing 21 includes a casing body 211 that covers the heating plate 22 and the water tube 3, and a mounting plate 213 that is disposed over the heating plate 22 and that cooperates with the heating plate 22 to define a steam chamber 212 therebetween (i.e., the heating plate 22 is disposed under the steam chamber 212). The water tube 3 extends through the mounting plate 213 into the steam chamber 212, and is spaced apart from the heating plate 22. The heating plate 22 is disposed for heating liquid water into steam. The control unit 23 is connected to the heating plate 22 for sensing the temperature of the heating plate 22 and controlling the heating power of the heating plate 22. Since the operation of the control unit 23 is known in the art, further details of the same are omitted herein for the sake of brevity.

The water tube 3 is disposed for pouring the liquid water into the steam chamber 212, in which the liquid water falls onto the heating plate 22. The water tube 3 includes a main body 31, a dividing body 32, and three ribs 33.

The main body 31 defines a channel 311 extending in a flowing direction (D1). The channel 311 has an inlet portion 312, an outlet portion 313 that is opposite to and disposed downstream of the inlet portion 312 and that extends into the steam chamber 212, and a neck portion 314 that is connected between the inlet portion 312 and the outlet portion 313. The inlet portion 312 has a width in a transverse direction perpendicular to the flowing direction (D1), and the width gradually decreases in the flowing direction (D1). Therefore, in this embodiment, the width of a top end of the inlet portion 312 is slightly larger than that of a bottom end of the inlet portion 312.

The dividing body 32 has a main section 321 that is inserted into the outlet portion 313 of the channel 311, a tip end section 322 that extends toward the inlet portion 312 of the channel 311 and that tapers away from the main section 321, and a connecting section 323 that interconnects the main section 321 and the tip end section 322 and that is disposed in the neck portion 31 of the channel 311.

The ribs 33 extend from the main section 321 of the dividing body 32 to the main body 31. The ribs 33 and the dividing body 32 are molded as one piece. The ribs 33 cooperate with the main section 321 of the dividing body 32 to divide the outlet portion 313 of the channel 311 into a plurality of outlet holes 315, such that the liquid water flowing through the channel 311 is divided by the dividing body 32 and the ribs 33 into a plurality of streams that are discharged respectively via the outlet holes 315 into the steam chamber 212 to fall onto the heating plate 22. Each of the outlet holes 315 has a width in the transverse direction that gradually increases in the flowing direction (D1).

As such, compared to the water tube 12 illustrated in the abovementioned conventional steamer 1, the liquid water is spread to a larger region on the heating plate (i.e., the contact area between the water and the heating plate 22 increases), thereby resulting in an improvement of the efficiency for converting the liquid water into steam. In addition, when the liquid water is poured onto the heating plate 22, due to the increased contact region between the water and the heating plate 22, the temperature of the heating plate 22 would be lowered more quickly. Once the control unit 23 detects the temperature drop, it will operate promptly to increase the heating power of the heating plate 22. Therefore, the time required for converting the liquid water into steam can also be reduced.

To be more specific, according to the configuration of the conventional steamer 1, liquid water is supplied into the water tube 12 under a rate of 100 grams per minute with some still flowing out of the conventional steamer 1 without being transformed into steam. However, the steamer 2 of the disclosure can work with the liquid water being supplied into the water tube 3 under a rate of 140 grams per minute and completely transformed into steam. By virtue of the improved steam-generating efficiency, the steamer 2 of the disclosure is suitable for removing creases on thick clothes. Moreover, the presence of the tip end section 322 of the dividing body 32 increases the flowing speed of the liquid water toward the outlet holes 315.

Figure 7:
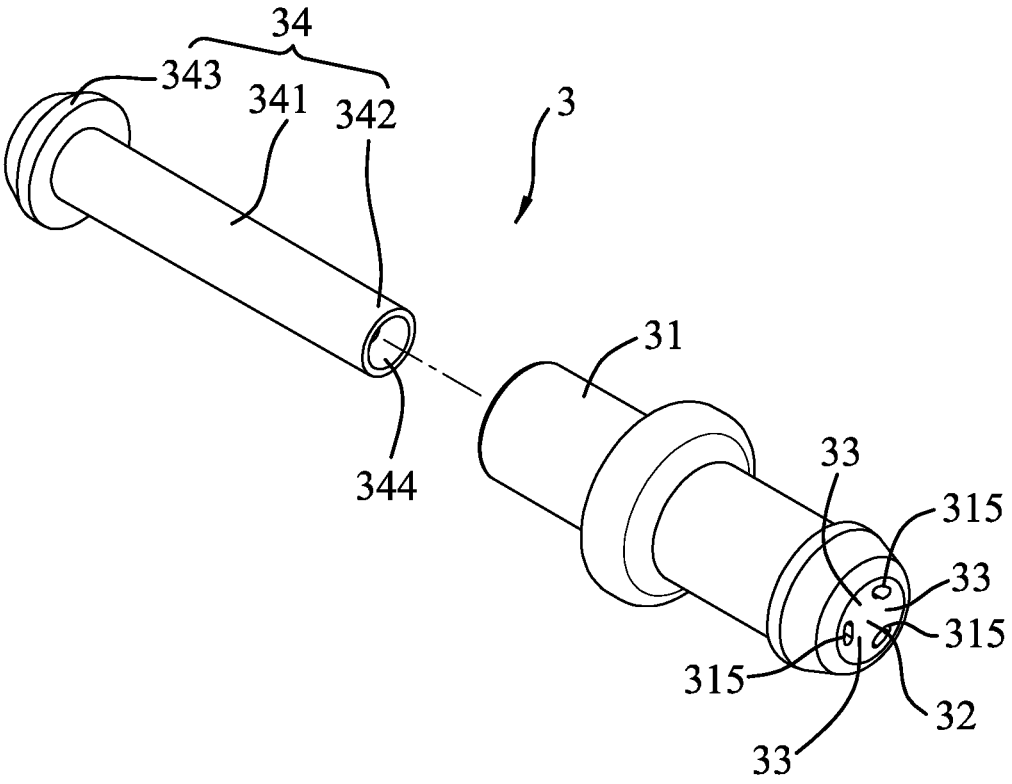
FIG. 7 is an exploded perspective view of a second embodiment of the water tube according to the disclosure.
Figure 8:
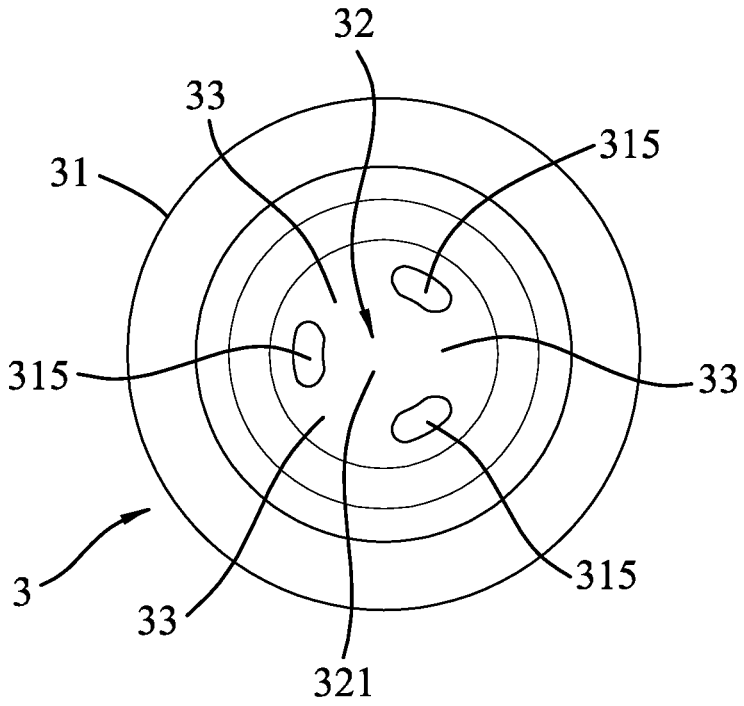
FIG. 8 is a bottom view of the second embodiment.
Figure 9:
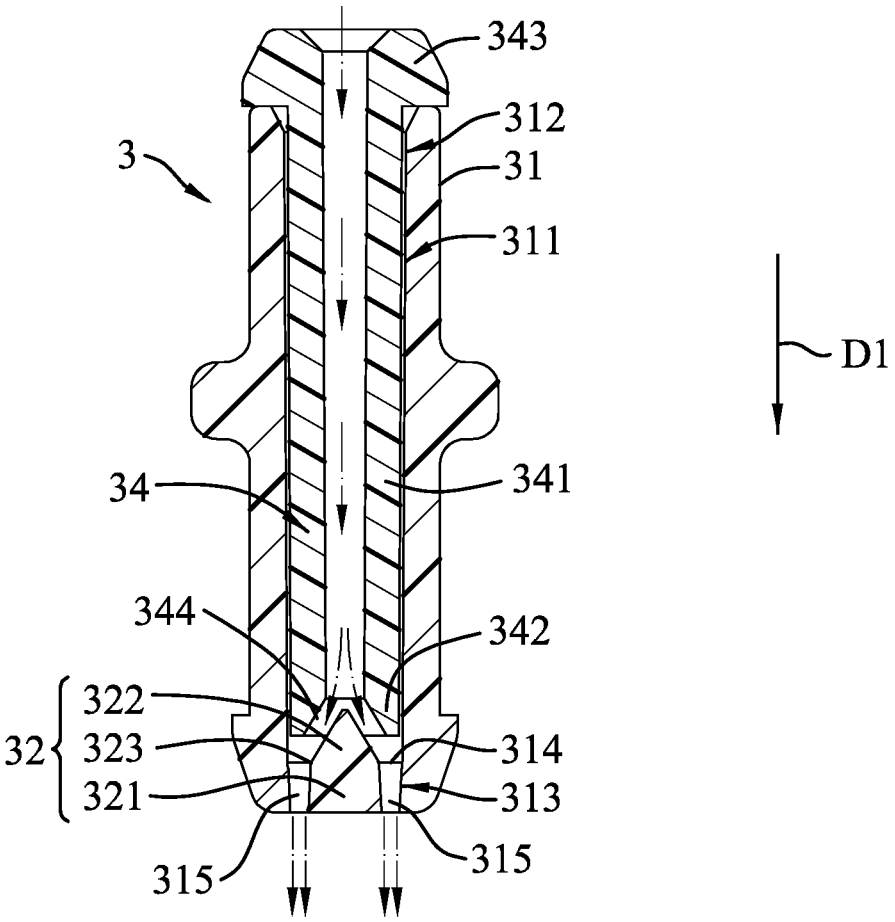
FIG. 9 is a sectional view of the second embodiment.

As shown in FIGS. 7 to 9, the second embodiment of the water tube 3 has a structure similar to that of the first embodiment. The main difference between this embodiment and the previous embodiment resides in the following. In this embodiment, the water tube 3 further includes an inner tubular body 34 inserted in the channel 311 of the main body 31. The inner tubular body 34 has a first wall portion 341, a second wall portion 342, and a head portion 343. The first wall portion 341 is disposed in the inlet portion 312 of the channel 311. The second wall portion 342 extends in the flowing direction (D1) from the first wall portion 341, and has a distal end defining a surrounding space area 344. The surrounding space area 344 has a width in the transverse direction gradually increasing in the flowing direction (D1). The tip end section 322 of the dividing body 32 is inserted into the surrounding space area 344. The head portion 343 is disposed outside of the inlet portion 312 of the channel 311, and abuts against an end of the main body 31. In this embodiment, the main section 321 of the dividing body 32 has a cross-section that gradually increases in the flowing direction (D1), and each of the outlet holes 315 of the channel 311 has a width in the transverse direction gradually decreasing in the flowing direction (D1). The second embodiment has the same advantages as those of the first embodiment. In addition, the configuration that the width of the channel 311 in the transverse direction decreases from the inlet portion 312 to the outlet portion 313, and that the width of each outlet hole 315 in the transverse direction decreases in the flowing direction (D1) facilitates removal of the main body 31 from a mold during the manufacturing process of the main body 31.

Figure 10:
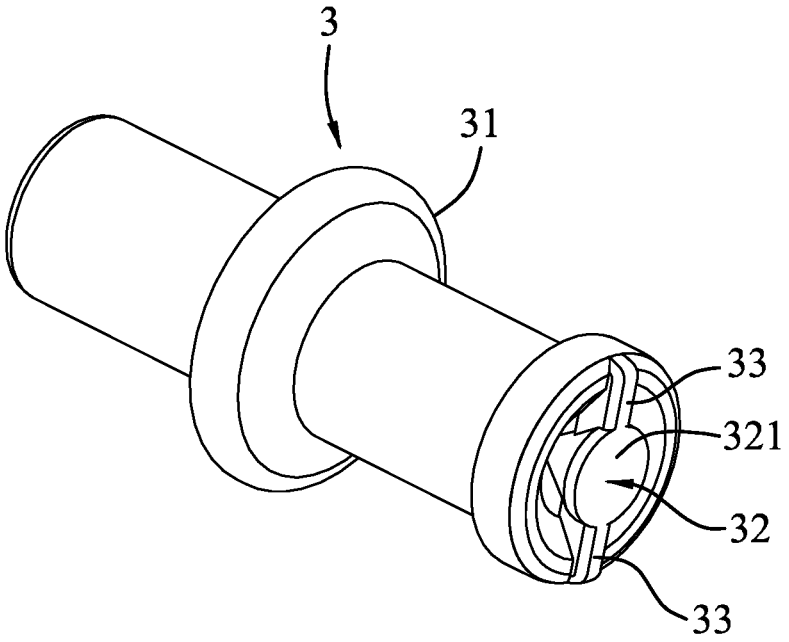
FIG. 10 is a perspective view of a third embodiment of the water tube according to the disclosure.
Figure 11:
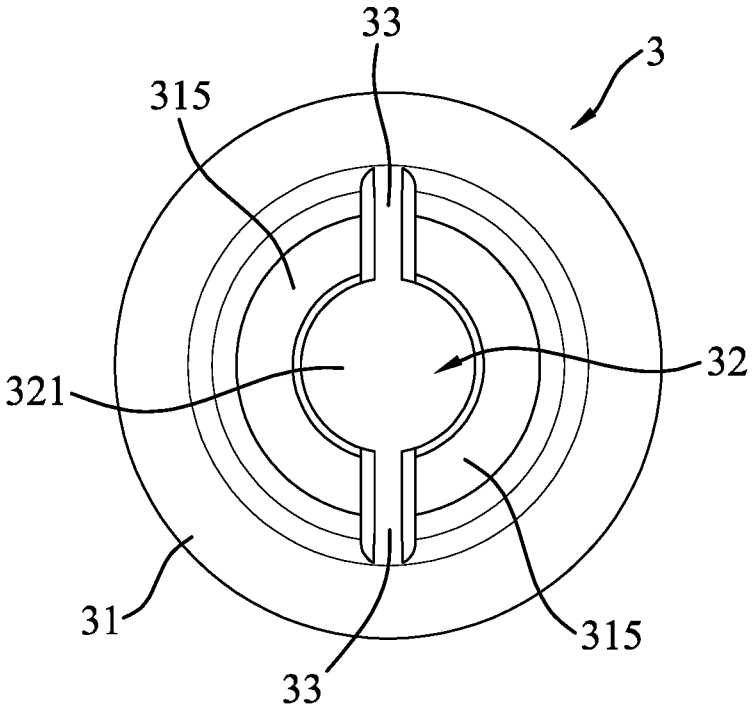
FIG. 11 is a bottom view of the third embodiment.
Figure 12:
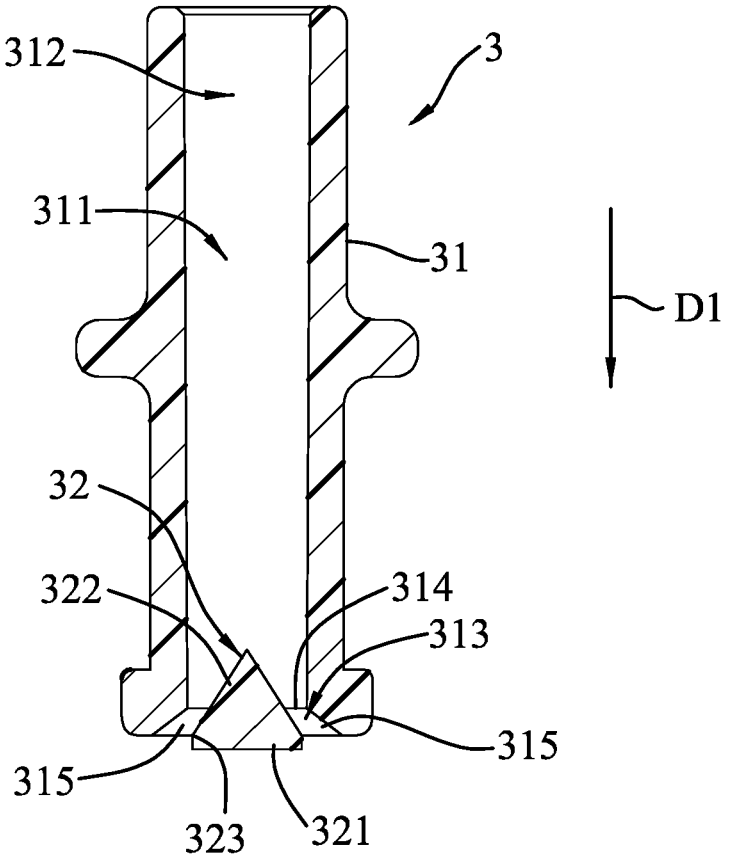
FIG. 12 is a sectional view of the third embodiment.

Referring to FIGS. 10 to 12, the third embodiment of the water tube 3 has a structure similar to that of the first embodiment. The main difference between this embodiment and the first embodiment resides in the following. In this embodiment, the main section 321 is disc-shaped, and is disposed outside of the outlet portion 313 of the channel 311. The water tube 3 has two ribs 33 that are diametrically opposite to each other. Each of the ribs 33 is plate-shaped, and has a thickness in the flowing direction (D1) and a width in the transverse direction which is smaller than the thickness, such that the ribs 33, the dividing body 32 and the main body 31 cooperatively define two semi-circular outlet holes 315. As such, for each outlet hole 315, the liquid water discharged therefrom forms a water curtain. The third embodiment has the same advantages as those of the first embodiment.

Figure 13:
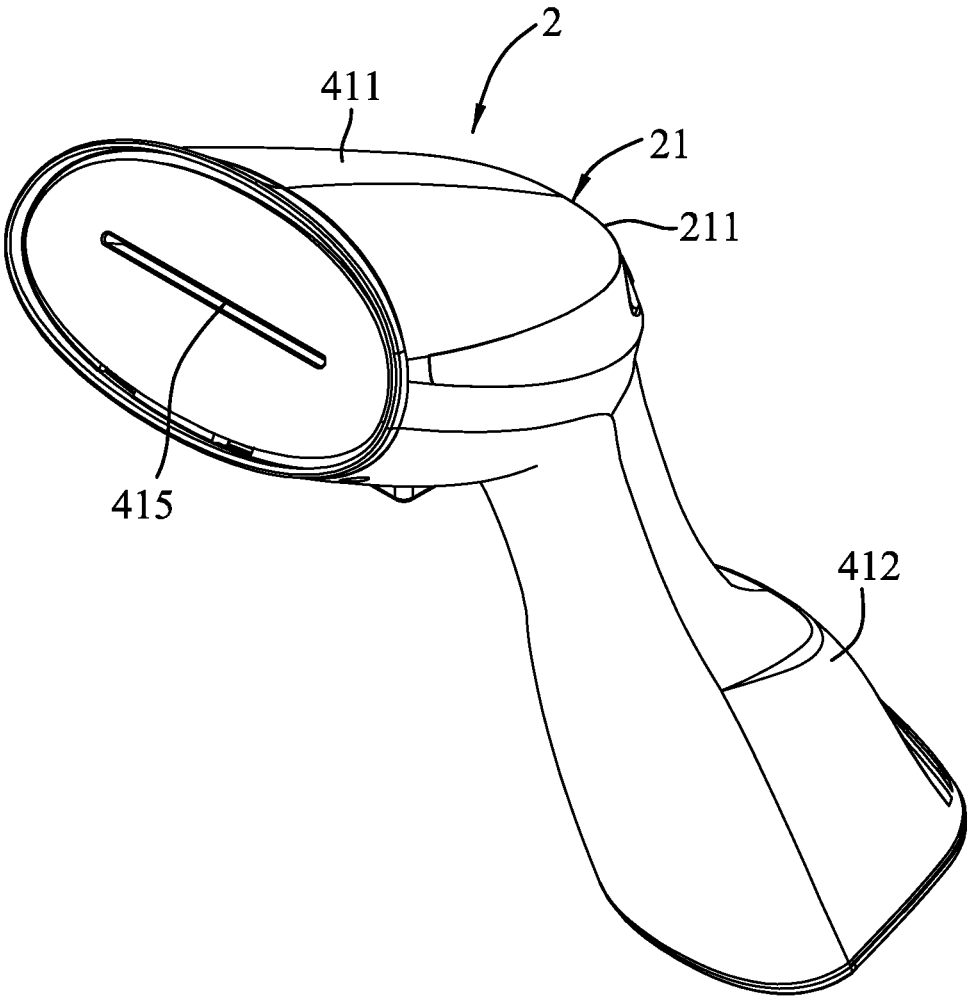
FIG. 13 is a perspective view of a handheld steamer.
Figure 14:
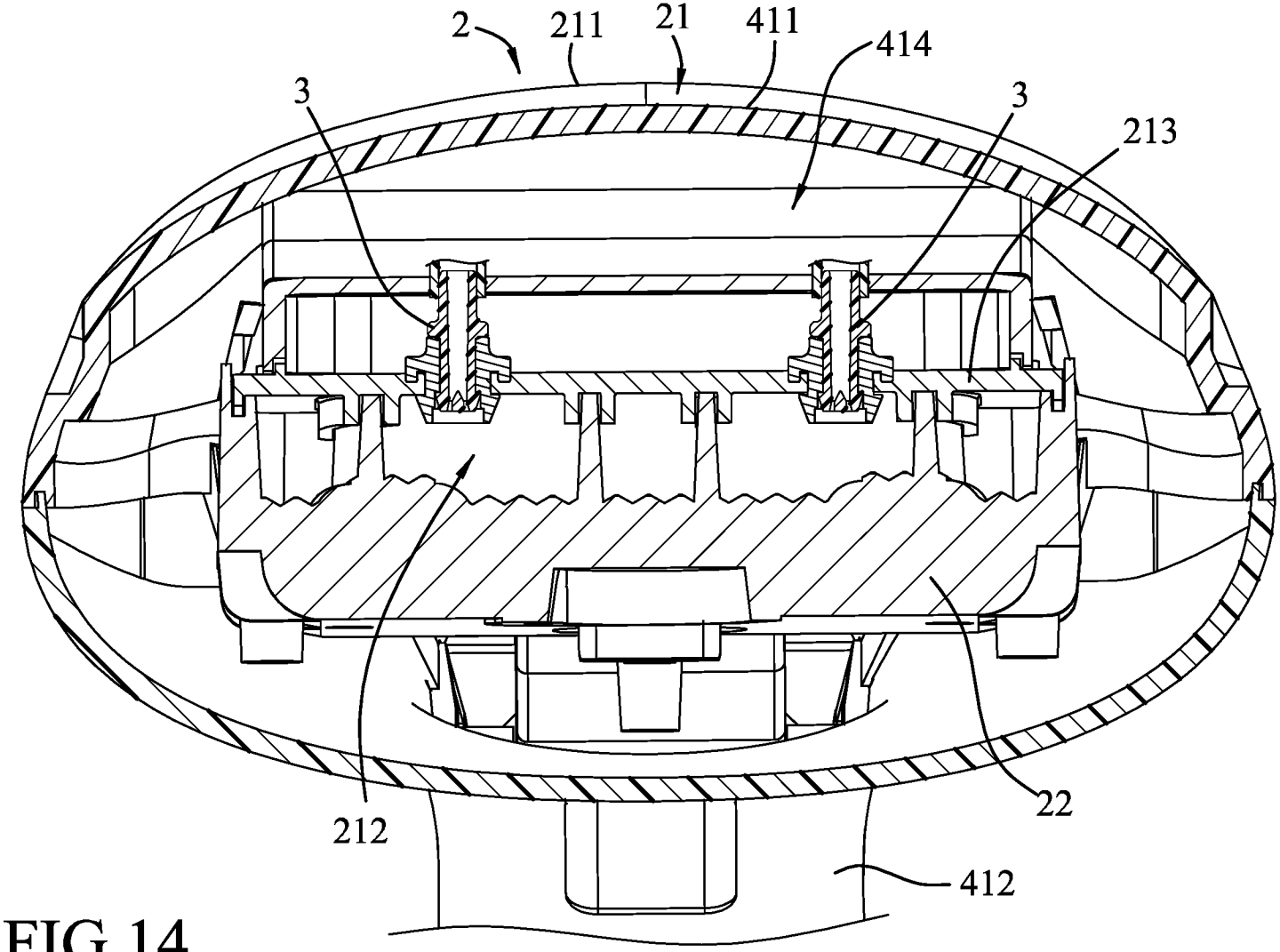
FIG. 14 is a fragmentary sectional view of the steamer illustrated in FIG. 13 mounted with two fourth embodiments of the water tube according to the disclosure.

Referring to FIGS. 13 and 14, the fourth embodiment of the water tube 3 has a structure identical to that of the first embodiment, but is adapted for use in a different kind of steamer. In this embodiment, the steamer 2 is configured as a handheld steamer, and the casing body 211 of the casing 21 has a head segment 411, and a handle segment 412 extending from the head segment 411. The head segment 411 and the handle segment 412 form an obtuse angle therebetween. The head segment 411 is hollow and defines a substantially elliptic mounting space 414. The mounting plate 213 and the heating plate 22 are mounted in the mounting space 414. The head segment 411 is formed with an outlet slit 415 for steam to flow out of the casing 21. In this embodiment, the steamer 2 includes two water tubes 3 mounted on the mounting plate 213.

Figure 15:
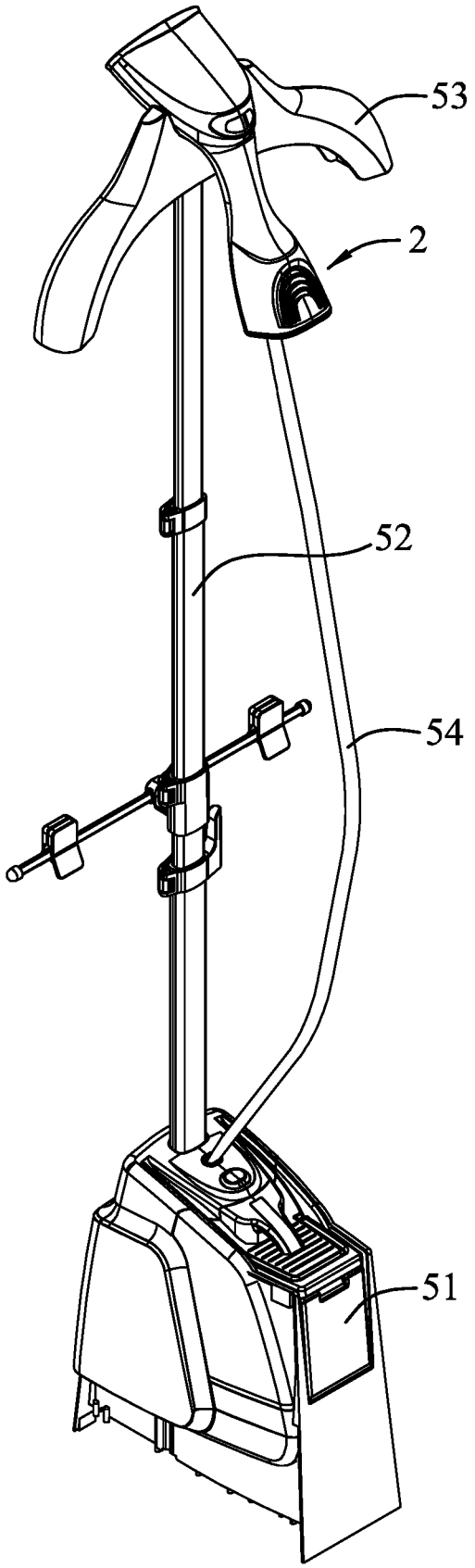
FIG. 15 is a perspective view of the steamer being equipped on a floor-type steamer device.

As shown in FIG. 15, the steamer 2 may be equipped on a floor-type steamer device. The steamer device includes a base seat 51 that is placed on the floor, an upright support rod 52 mounted on the base seat 51, a hanger 53 that is coupled to a top end of the support rod 52, and a water hose 54 connected to the base seat 51. The steamer 2 is connected to a free end of the water hose 54.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A water tube adapted for use in a steamer, the steamer having a steam chamber and a heating plate that is disposed under the steam chamber, said water tube comprising:

a tubular main body that defines a channel extending in a flowing direction, said channel having an inlet portion and an outlet portion that is opposite to and disposed downstream of said inlet portion, and that is adapted to extend into the steam chamber;

a dividing body that is inserted into said outlet portion of said channel; and a plurality of ribs that extend from said dividing body to said main body, and that cooperate with said dividing body to divide said outlet portion of said channel into a plurality of outlet holes, such that water which enters said channel from said inlet portion is divided by said dividing body and said ribs into a plurality of streams that are adapted to be discharged respectively via said outlet holes into the steam chamber to fall onto the heating plate;

wherein said dividing body has a main section, and a tip end section that extends toward said inlet portion of said channel, and that tapers away from said main section; and wherein said ribs extend from said main section of said dividing body to said main body.

2. The water tube as claimed in claim 1, wherein:

said channel of said main body further has a neck portion connected between said inlet portion and said outlet portion; and each of said outlet holes of said channel has a width in a transverse direction perpendicular to the flowing direction that gradually increases in the flowing direction.

3. The water tube as claimed in claim 2, wherein said dividing body further has a connecting section interconnecting said main section and said tip end section, and disposed in said neck portion of said channel.

4. The water tube as claimed in claim 1, further comprising an inner tubular body inserted in said channel of said main body, and having:

a first wall portion that is disposed in said inlet portion of said channel; and a second wall portion that extends in the flowing direction from said first wall portion, and that has a distal end defining a surrounding space area, said surrounding space area having a width in a transverse direction that is perpendicular to the flowing direction that gradually increases in the flowing direction, said tip end section of said dividing body being inserted into said surrounding space area.

5. The water tube as claimed in claim 4, wherein each of said outlet holes of said channel has a width in the transverse direction that gradually decreases in the flowing direction.

6. The water tube as claimed in claim 5, wherein said main section of said dividing body has a cross-section that gradually increases in the flowing direction.

7. The water tube as claimed in claim 6, wherein said inner tubular body further has a head portion disposed outside of said inlet portion of said channel, and abutting against an end of said main body.

8. The water tube as claimed in claim 1, wherein:

said main section of said dividing body is disc-shaped, and has at least a portion disposed outside of said outlet portion of said channel; and each of said ribs is plate-shaped, and has a thickness in the flowing direction and a width in the transverse direction which is smaller than the thickness.

9. A steamer comprising:

a casing;

a heating plate that is coupled to said casing, and that cooperates with said casing to define a steam chamber therebetween; and a water tube as claimed in claim 1 mounted in said casing and extending into said steam chamber.

10. The steamer as claimed in claim 9, wherein:

said channel of said main body further has a neck portion connected between said inlet portion and said outlet portion; and each of said outlet holes of said channel has a width in a transverse direction perpendicular to the flowing direction that gradually increases in the flowing direction.

11. The steamer as claimed in claim 10, wherein said dividing body further has a connecting section interconnecting said main section and said tip end section, and disposed in said neck portion of said channel.

12. The steamer as claimed in claim 9, wherein said water tube further includes an inner tubular body inserted in said channel of said main body, and having:

a first wall portion that is disposed in said inlet portion of said channel; and a second wall portion that extends in the flowing direction from said first wall portion, that has a distal end defining a surrounding space area, said surrounding space area having a width in a transverse direction that is perpendicular to the flowing direction that gradually increases in the flowing direction, said tip end section of said dividing body being inserted into said surrounding space area.

13. The steamer as claimed in claim 12, wherein each of said outlet holes of said channel has a width in the transverse direction that gradually decreases in the flowing direction.

14. The steamer as claimed in claim 13, wherein said main section of said dividing body has a cross-section that gradually increases in the flowing direction.

15. The steamer as claimed in claim 14, wherein said inner tubular body further has a head portion disposed outside of said inlet portion of said channel, and abutting against an end of said main body.

16. The steamer as claimed in claim 9, wherein:

said main section of said dividing body is disc-shaped, and has at least a portion disposed outside of said outlet portion of said channel; and each of said ribs is plate-shaped, and has a thickness in the flowing direction and a width in the transverse direction which is smaller than the thickness.

17. The steamer as claimed in claim 9, wherein:

said dividing body has a main section, and a tip end section that extends from said main section toward said inlet portion of said channel, and that tapers away from said main section; and wherein said ribs extend from said main section of said dividing body to said main body.

* * * * *